US008257028B2

(12) United States Patent
Morgan et al.

(10) Patent No.: US 8,257,028 B2
(45) Date of Patent: Sep. 4, 2012

(54) TURBINE NOZZLE SEGMENT

(75) Inventors: Clive Andrew Morgan, Cincinnati, OH (US); Todd Stephen Heffron, Harrison, OH (US); Sanjeewa Thusitha Fonseka, Dublin, OH (US)

(73) Assignee: General Electric Company, Schenectady, NY (US)

( * ) Notice: Subject to any disclaimer, the term of this patent is extended or adjusted under 35 U.S.C. 154(b) by 1125 days.

(21) Appl. No.: 11/967,176

(22) Filed: Dec. 29, 2007

(65) Prior Publication Data

US 2009/0169370 A1 Jul. 2, 2009

(51) Int. Cl.
*F16J 15/02* (2006.01)
*F01D 11/00* (2006.01)

(52) U.S. Cl. ..... 415/135; 415/209.3

(58) Field of Classification Search ..... 415/209.3, 415/214.1, 190, 209.4, 135
See application file for complete search history.

(56) References Cited

U.S. PATENT DOCUMENTS

| | | | | |
|---|---|---|---|---|
| 5,118,120 | A * | 6/1992 | Drerup et al. | 415/135 |
| 5,797,723 | A | 8/1998 | Frost et al. | |
| 6,418,727 | B1 * | 7/2002 | Rice et al. | 60/799 |
| 6,431,555 | B1 | 8/2002 | Schroder et al. | |
| 2004/0239050 | A1 * | 12/2004 | Antunes et al. | 277/630 |

FOREIGN PATENT DOCUMENTS

| | | |
|---|---|---|
| EP | 1445537 | 8/2004 |

* cited by examiner

*Primary Examiner* — Richard Edgar
(74) *Attorney, Agent, or Firm* — General Electric Company; William Scott Andes; David J. Clement

(57) ABSTRACT

A turbine nozzle segment includes a band having a plurality of tabs, an airfoil extending from the band and a support structure attached to the tabs. The support structure has a plurality of biasing structures.

20 Claims, 16 Drawing Sheets

TURBINE NOZZLE SEGMENT

BACKGROUND OF THE INVENTION

The exemplary embodiments relate generally to gas turbine engine components and more specifically to leaf seal assemblies for turbine nozzle assemblies.

Gas turbine engines typically include a compressor, a combustor, and at least one turbine. The compressor may compress air, which may be mixed with fuel and channeled to the combustor. The mixture may then be ignited for generating hot combustion gases, and the combustion gases may be channeled to the turbine. The turbine may extract energy from the combustion gases for powering the compressor, as well as producing useful work to propel an aircraft in flight or to power a load, such as an electrical generator.

The turbine may include a stator assembly and a rotor assembly. The stator assembly may include a stationary nozzle assembly having a plurality of circumferentially spaced apart airfoils extending radially between inner and outer bands, which define a flow path for channeling combustion gases therethrough. Typically the airfoils and bands are formed into a plurality of segments, which may include one (typically called a singlet) or two spaced apart airfoils radially extending between an inner and an outer band. The segments are joined together to form the nozzle assembly.

The rotor assembly may be downstream of the stator assembly and may include a plurality of blades extending radially outward from a disk. Each rotor blade may include an airfoil, which may extend between a platform and a tip. Each rotor blade may also include a root that may extend below the platform and be received in a corresponding slot in the disk. Alternatively, the disk may be a blisk or bladed disk, which may alleviate the need for a root and the airfoil may extend directly from the disk. The rotor assembly may be bounded radially at the tip by a stationary annular shroud. The shrouds and platforms (or disk, in the case of a blisk) define a flow path for channeling the combustion gases therethrough. The nozzles and shrouds are separately manufactured and assembled into the engine. Accordingly, gaps are necessarily provided therebetween for both assembly purposes as well as for accommodating differential thermal expansion and contraction during operation of the engine.

The gaps between the stationary components are suitably sealed for preventing leakage therethrough. In a typical turbine nozzle, a portion of air is bled from the compressor and channeled through the nozzles for cooling thereof. The use of bleed air reduces the overall efficiency of the engine and, therefore, is minimized whenever possible. The bleed air is at a relatively high pressure, which is greater than the pressure of the combustion gases flowing through the turbine nozzle. As such, the bleed air would leak into the flow path if suitable seals were not provided between the stationary components.

A typical seal used to seal these gaps is a leaf seal. A typical leaf seal is arcuate and disposed end to end around the circumference of the stator components. For example, the radially outer band of the nozzle includes axially spaced apart forward and aft rails. The rails extend radially outwardly and abut a complementary surface of an adjoining structural component, such as, but not limited to, a shroud, a shroud hanger, and/or a combustor liner, for providing a primary friction seal therewith. The leaf seal provides a secondary seal at this junction and bridges a portion of the rail and the adjoining structural component. Leaf seals are typically relatively thin, compliant sections, which are adapted to slide along a pin fixed to one of the adjoining structural components.

Regardless of the particular shape of the structural components to be sealed, leaf seals are movable to a closed, sealing position in which they engage each structural component and seal the space therebetween, and an open position in which at least one portion of the leaf seals disengage a structural component and allow the passage of gases in between such components. In most applications, movement of the leaf seals along the pins to a closed position is affected by applying a pressure differential across seal, i.e., relatively high pressure on one side of the seal and comparatively low pressure on the opposite side thereof forces the seal to a closed, sealed position against surfaces of the adjoining structural components to prevent the passage of gases therebetween.

While leaf seals have found widespread use in turbine engines, their effectiveness in creating a fluid tight seal is dependent on the presence of a sufficient pressure differential between one side of the seal and the other. During certain operating stages of a turbine engine, the difference in fluid pressure on opposite sides of the leaf seals is relatively low. Under these conditions, it is possible for the leaf seals to unseat from their engagement with the abutting structural components of the turbo machine and allow leakage therebetween. A relatively small pressure differential across the leaf seals also permits movement or vibration of the leaf seals with respect to the structural components that they contact. This vibration of the leaf seals, which is caused by operation of the turbine engine and other sources, creates undesirable wear both of the leaf seals and the surfaces of the structural components against which the leaf seals rest. Such wear not only results in leakage of gases between the leaf seals and structural components of the turbine engine, but can cause premature failure thereof.

To overcome this problem, other designs have included a biasing structure, such as a spring, to bias the leaf seal toward a certain position. For example, a band may have two circumferentially spaced apart, radially extending tabs spaced axially from a rail. A recess may be formed between the tabs and the rail where the leaf seal and spring are disposed. The tabs, leaf seals and springs may include holes for receiving a pin for mounting to the band. At least one of the tabs is typically spaced apart from the circumferential edges of the band. The tab, leaf seal and spring are arranged so that the spring forces the leaf seal against an adjoining structural component so as to maintain the leaf seal in a closed, sealed position at all times.

In some instances, such as, but not limited to, low emissions combustors, this configuration is not sufficient. For example, low emissions combustors are susceptible to flame instability, which may lead to acoustic resonance and high dynamic pressure variation. The high frequency pressure fluctuations can damage the leaf seals, particularly the leaf seals between the aft edge of the combustor liner and the leading edge of the nozzle bands, by repeatedly loading and unloading the seals against the adjoining structural component. The seals are particularly susceptible to damage where they are unsupported by the springs and/or tabs. The seals may not be fully supported at their circumferential edges and/or between the tabs on the bands.

BRIEF DESCRIPTION OF THE INVENTION

In one exemplary embodiment, a turbine nozzle segment includes a band having a plurality of tabs, an airfoil extending from the band and a support structure attached to the tabs. The support structure has a plurality of biasing structures.

In another exemplary embodiment, a turbine nozzle segment includes a band having a plurality of tabs, an airfoil extending from the band and a support structure attached to the tabs. The support structure has a plurality of biasing structures spaced circumferentially apart. One of the biasing structures is adjacent a first circumferential edge of the band and another of the biasing structures is adjacent a second circumferential edge of the band.

DETAILED DESCRIPTION OF THE INVENTION

Figure 1:
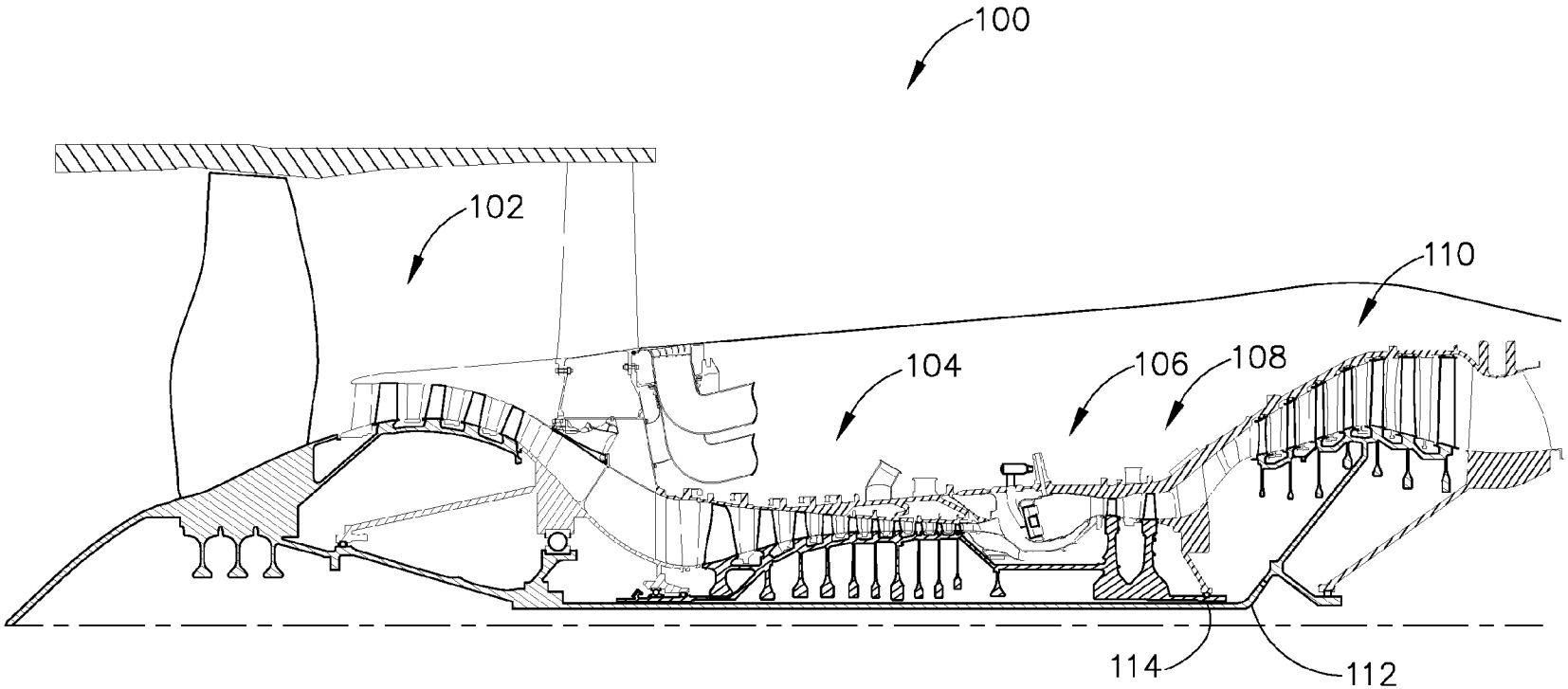
FIG. 1 is a cross-sectional schematic view of an exemplary gas turbine engine.

FIG. 1 illustrates a cross-sectional schematic view of an exemplary gas turbine engine 100. The gas turbine engine 100 may include a low-pressure compressor 102, a high-pressure compressor 104, a combustor 106, a high-pressure turbine 108, and a low-pressure turbine 110. The low-pressure compressor may be coupled to the low-pressure turbine through a shaft 112. The high-pressure compressor 104 may be coupled to the high-pressure turbine 108 through a shaft 114. In operation, air flows through the low-pressure compressor 102 and high-pressure compressor 104. The highly compressed air is delivered to the combustor 106, where it is mixed with a fuel and ignited to generate combustion gases. The combustion gases are channeled from the combustor 106 to drive the turbines 108 and 110. The turbine 110 drives the low-pressure compressor 102 by way of shaft 112. The turbine 108 drives the high-pressure compressor 104 by way of shaft 114.

Figure 2:
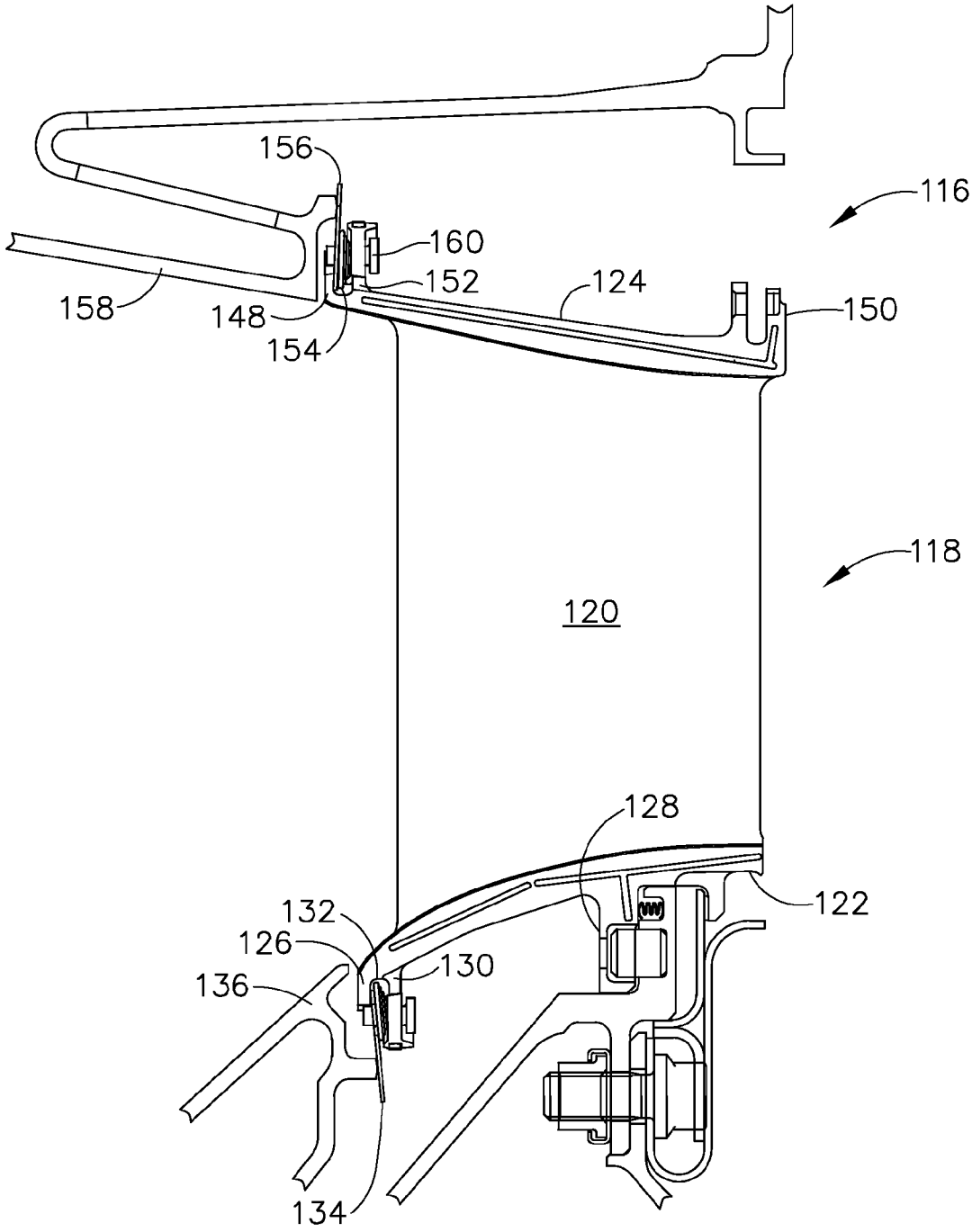
FIG. 2 is a cross-sectional schematic view of an exemplary turbine nozzle assembly.
Figure 3:
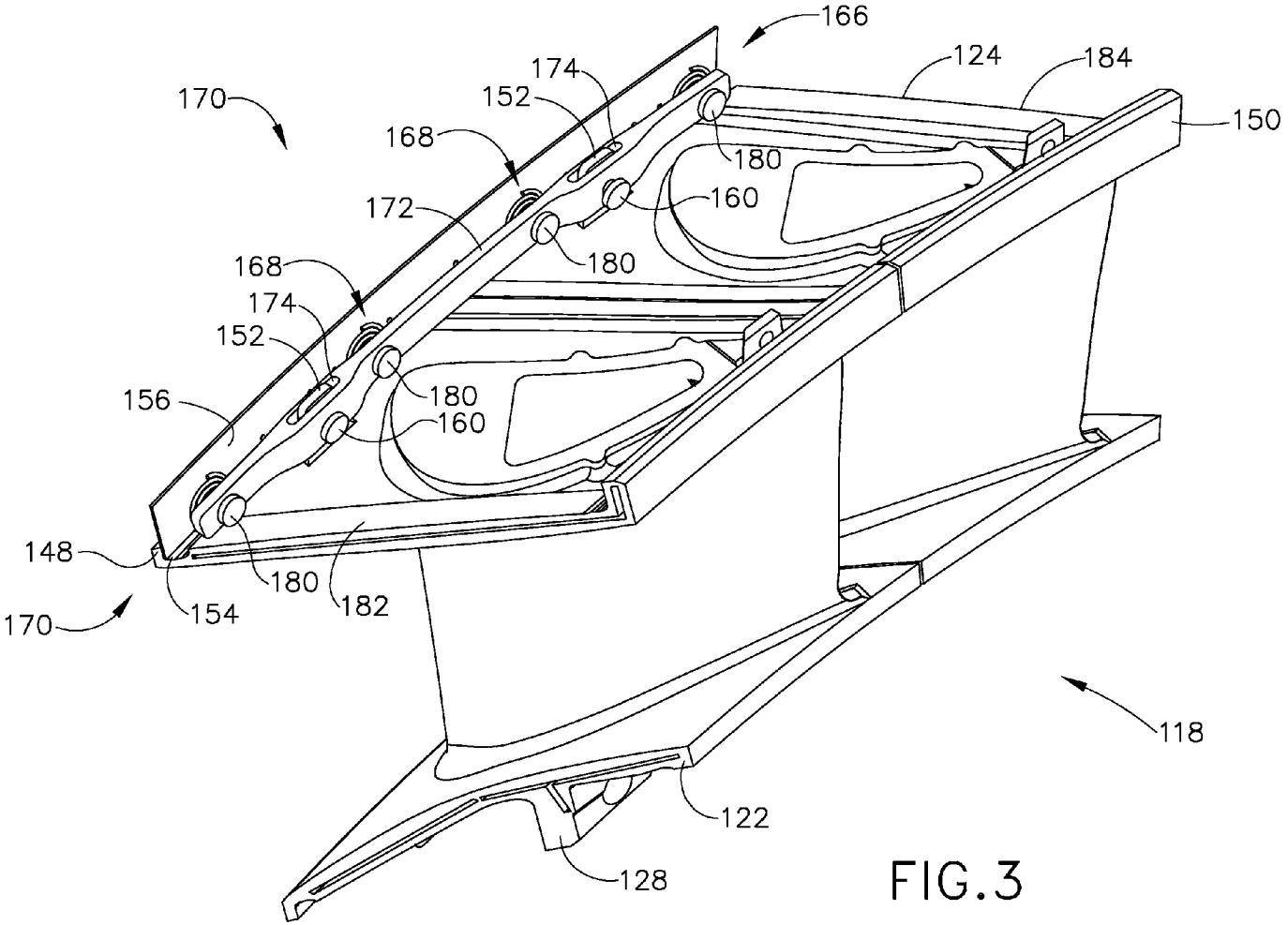
FIG. 3 is a perspective view of an exemplary turbine nozzle segment.
Figure 4:
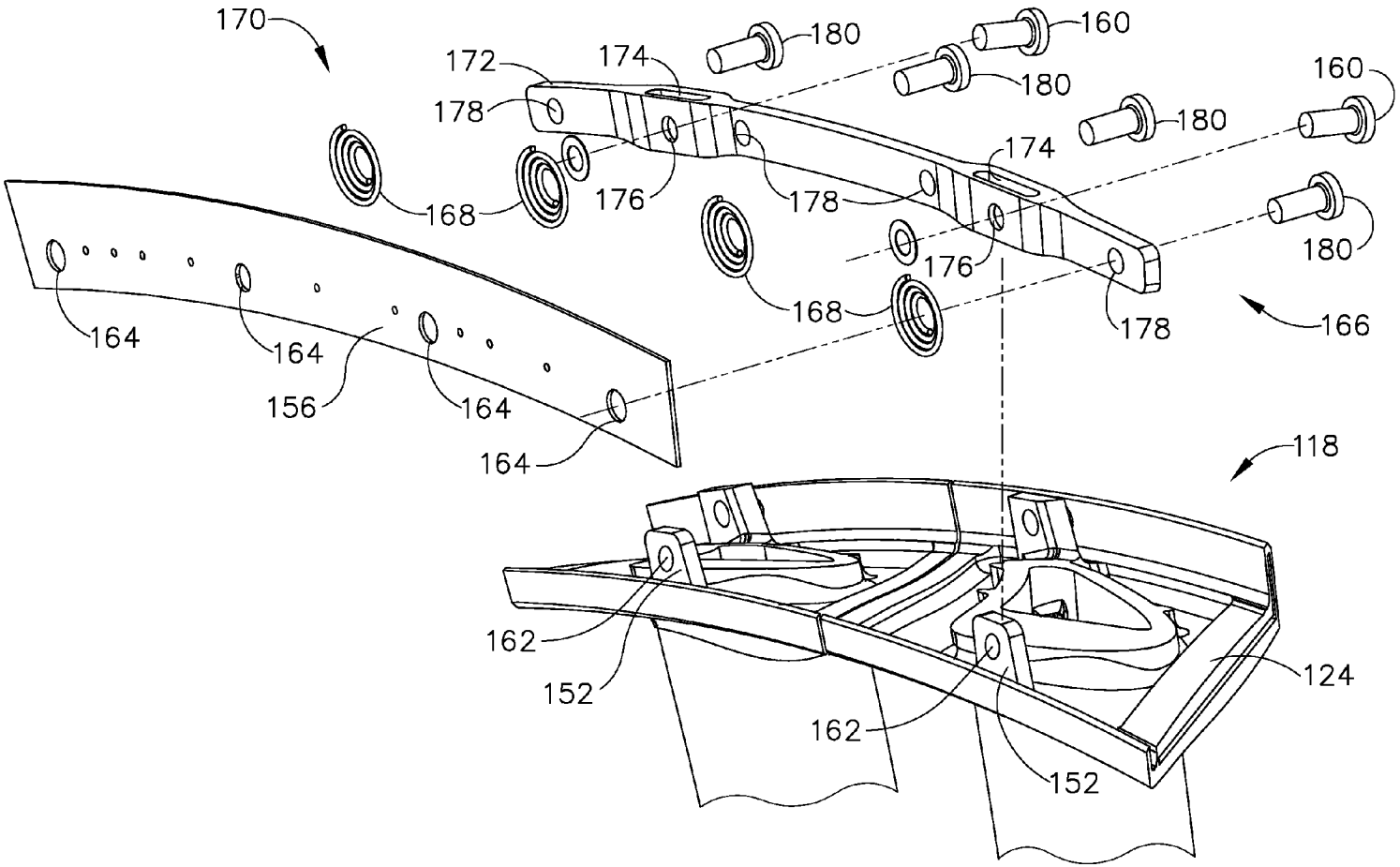
FIG. 4 is a perspective view of an exemplary support structure for use in an exemplary turbine nozzle segment.
Figure 5:
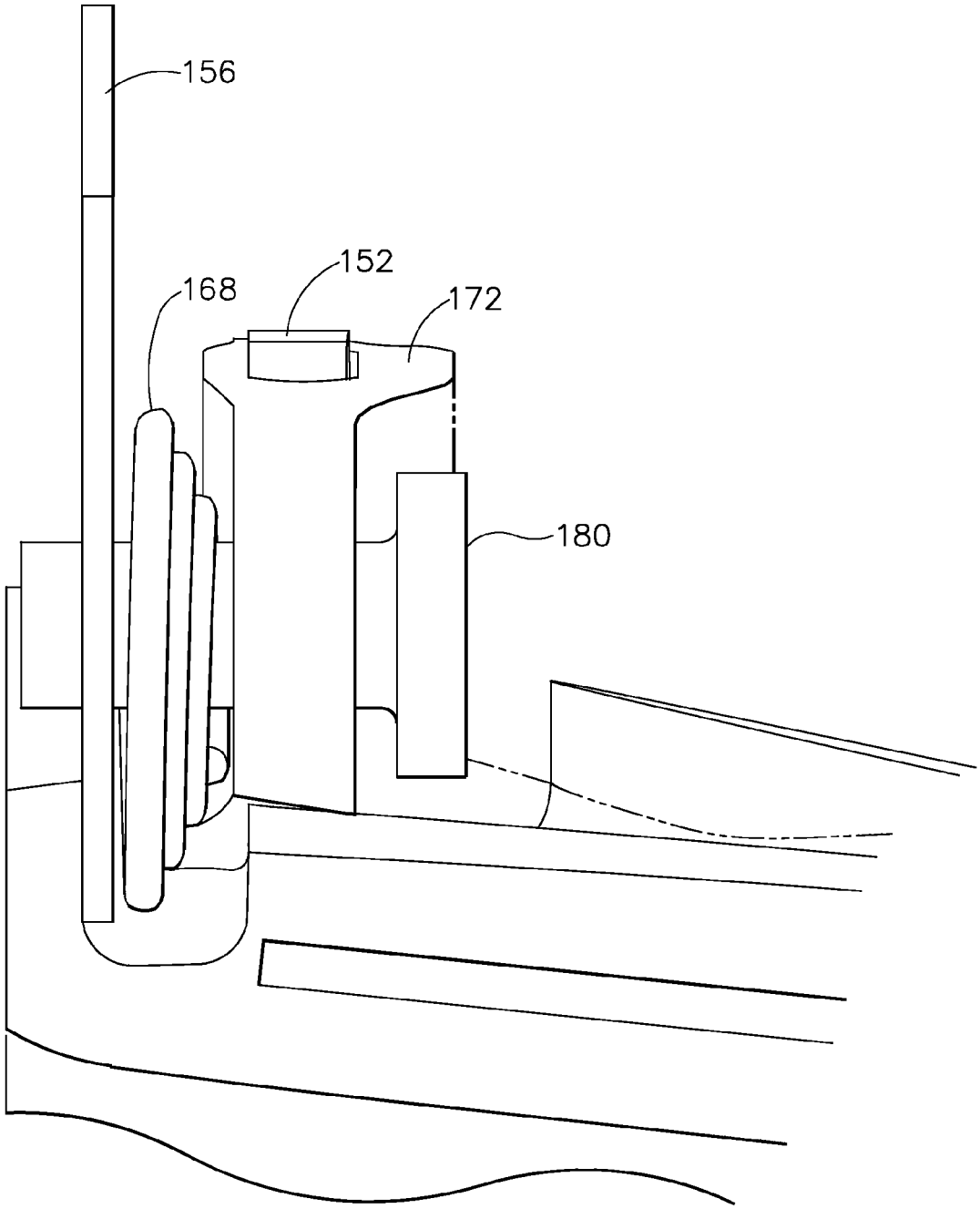
FIG. 5 is a close-up cross-sectional view of an exemplary turbine nozzle leaf seal assembly.
Figure 6:
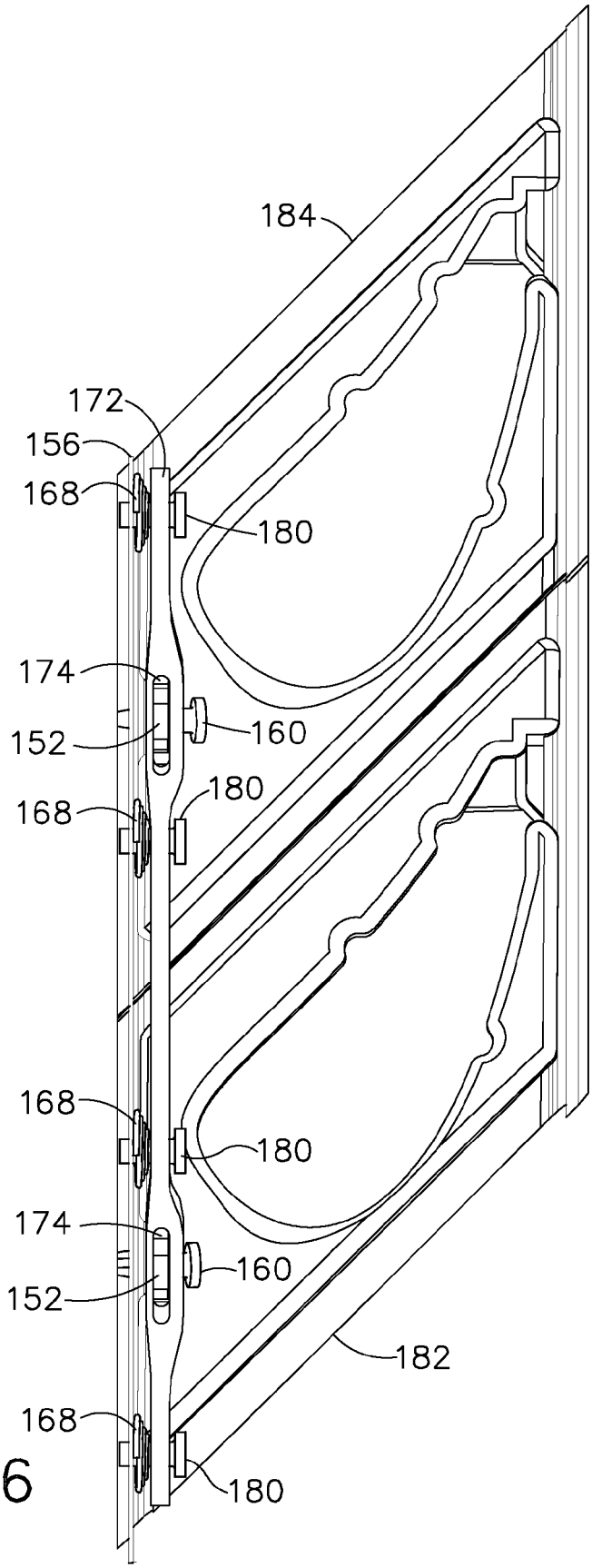
FIG. 6 is a top view of an exemplary turbine nozzle segment.
Figure 7:
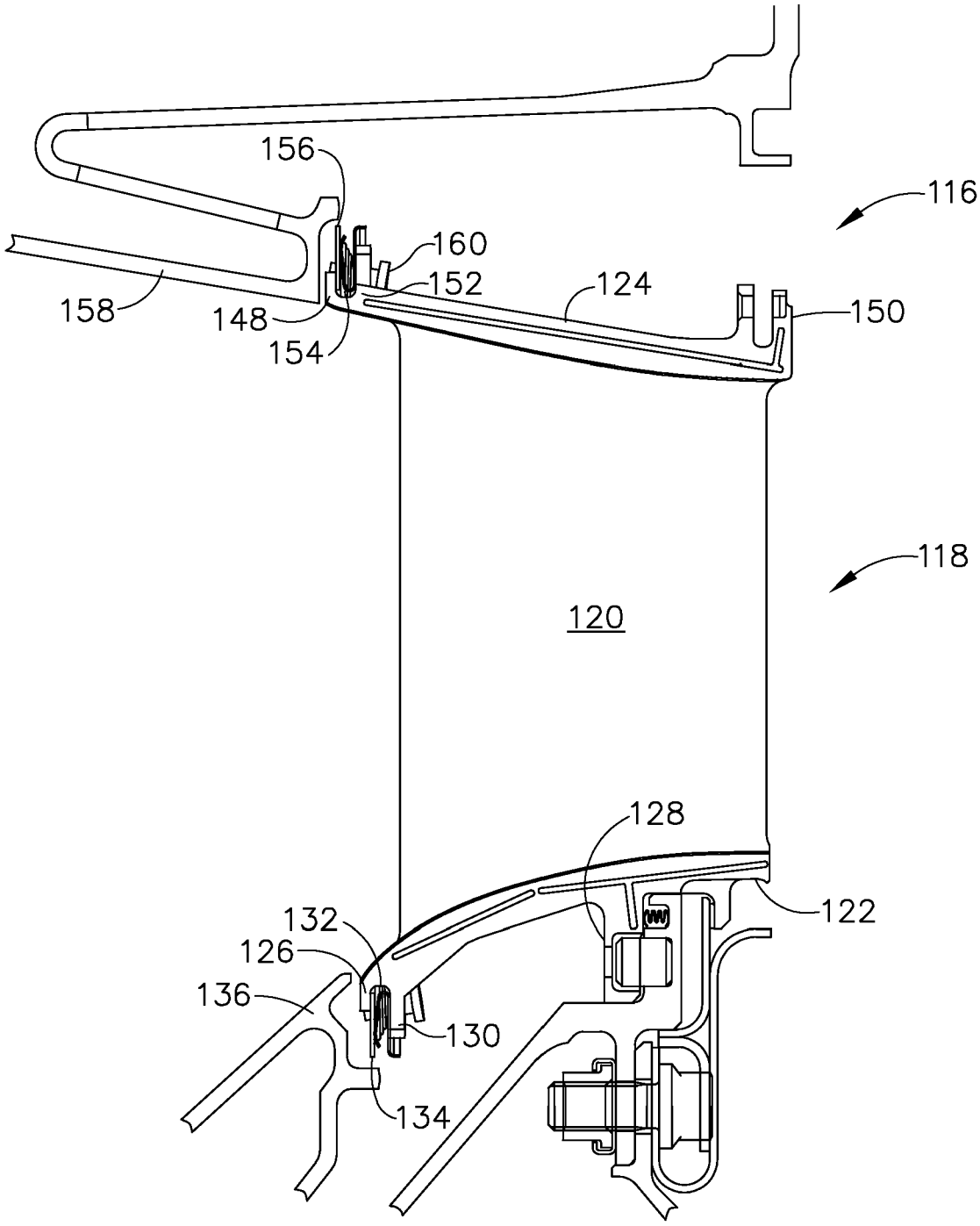
FIG. 7 is a cross-sectional schematic view of another exemplary turbine nozzle assembly.
Figure 8:
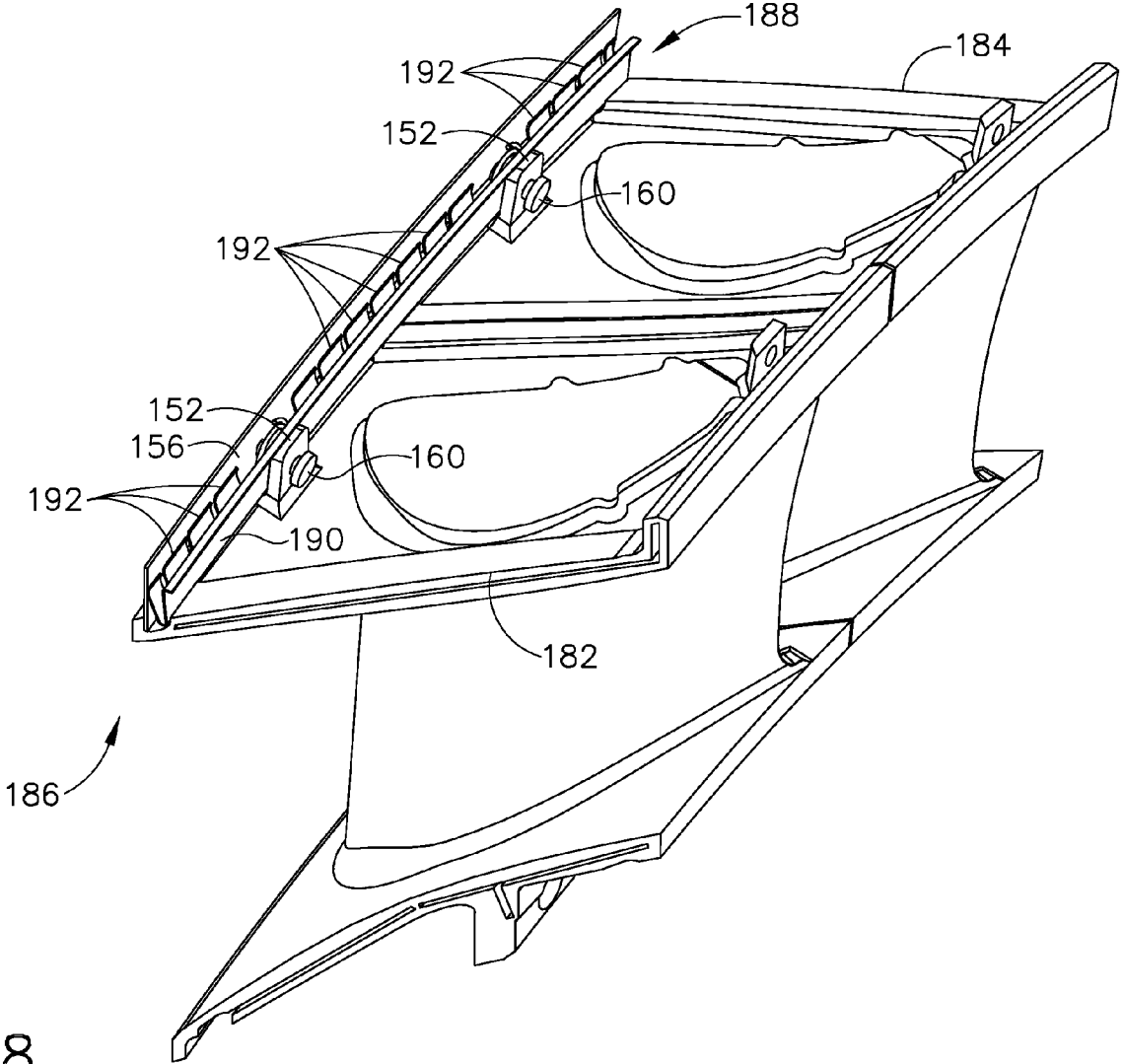
FIG. 8 is a perspective view of another exemplary turbine nozzle segment.
Figure 9:
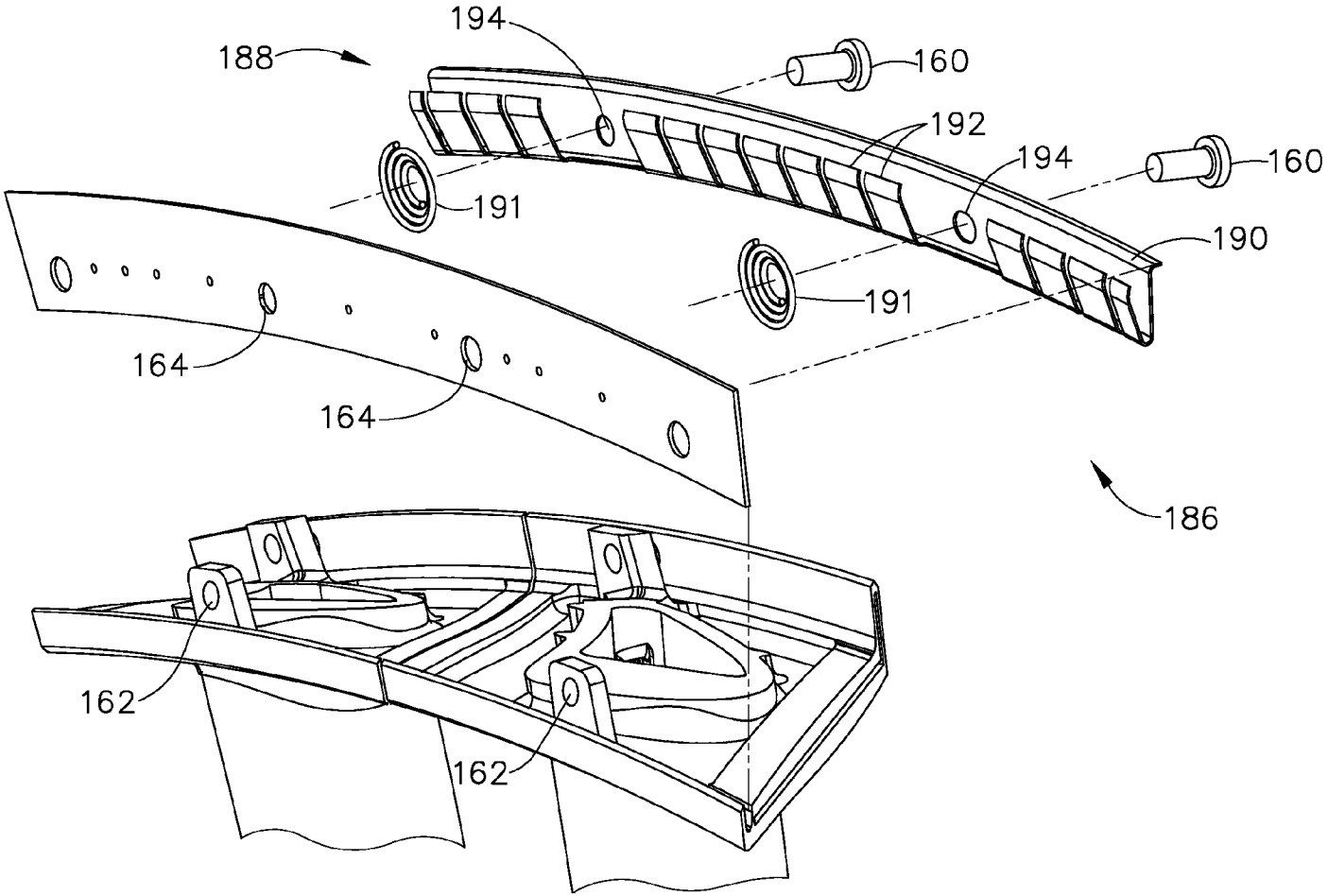
FIG. 9 is a perspective view of another exemplary support structure for use in an exemplary turbine nozzle segment.
Figure 10:
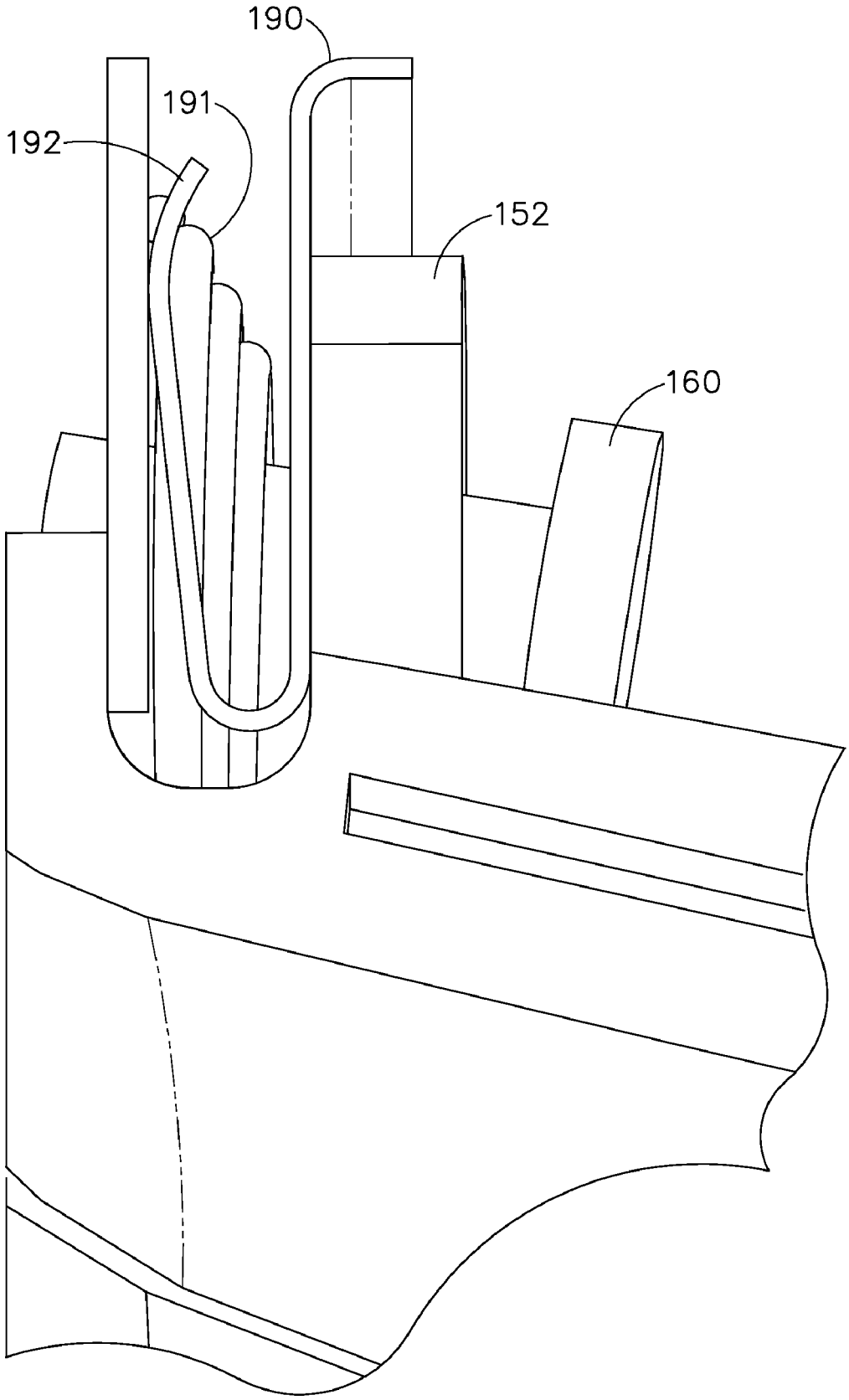
FIG. 10 is a close-up cross-sectional view of another exemplary turbine nozzle leaf seal assembly.
Figure 11:
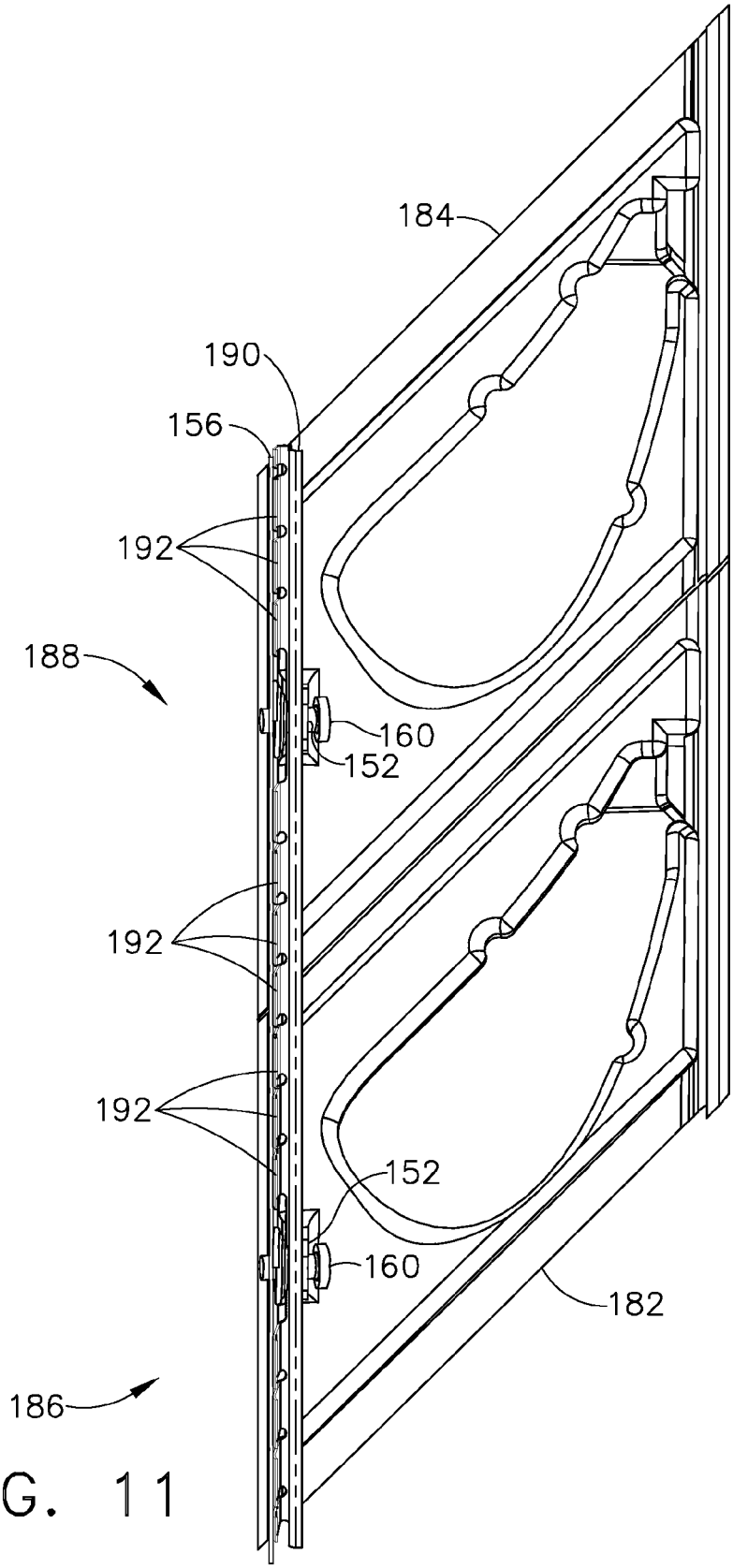
FIG. 11 is a top view of another exemplary turbine nozzle segment.
Figure 12:
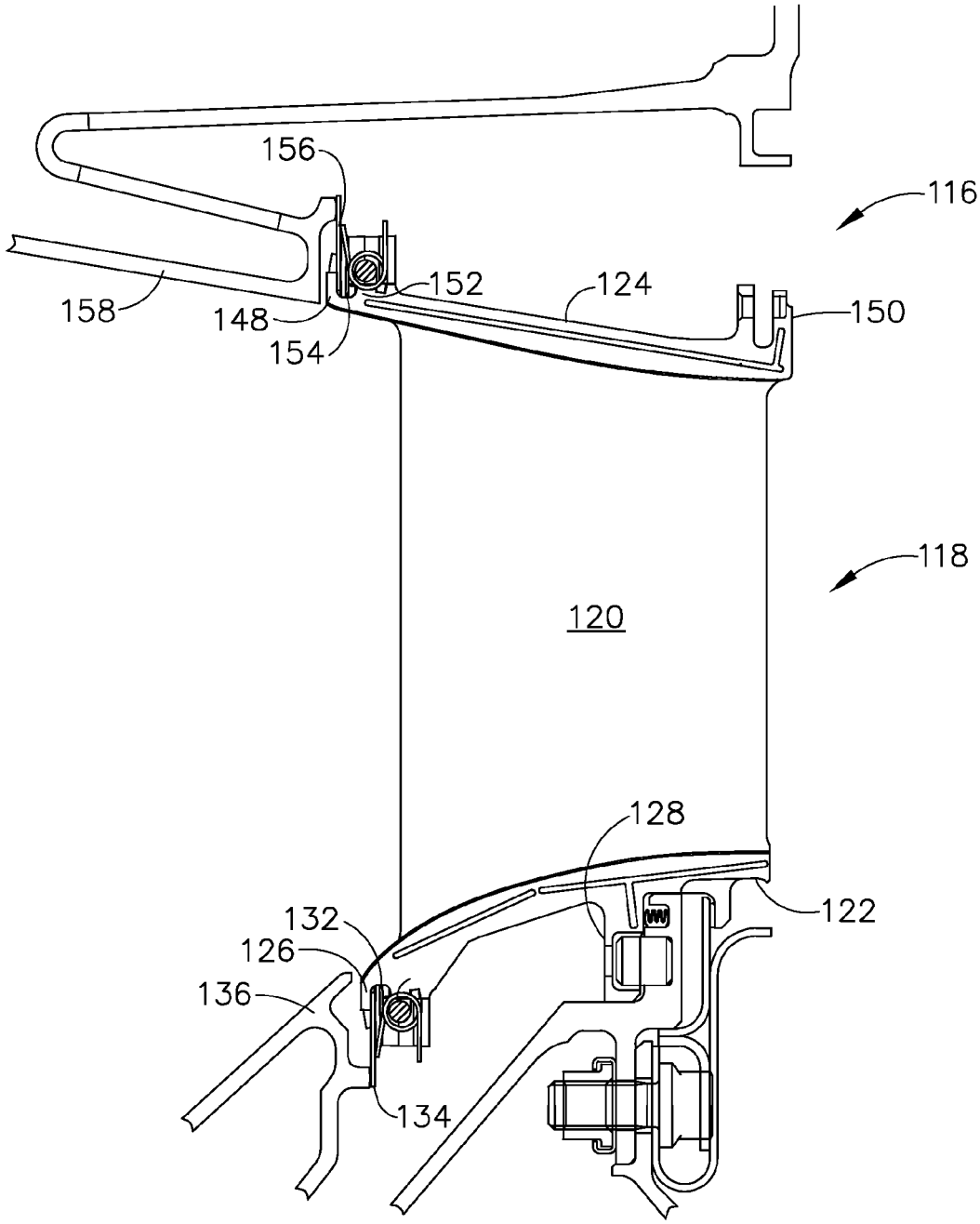
FIG. 12 is a cross-sectional schematic view of yet another exemplary turbine nozzle assembly.
Figure 13:
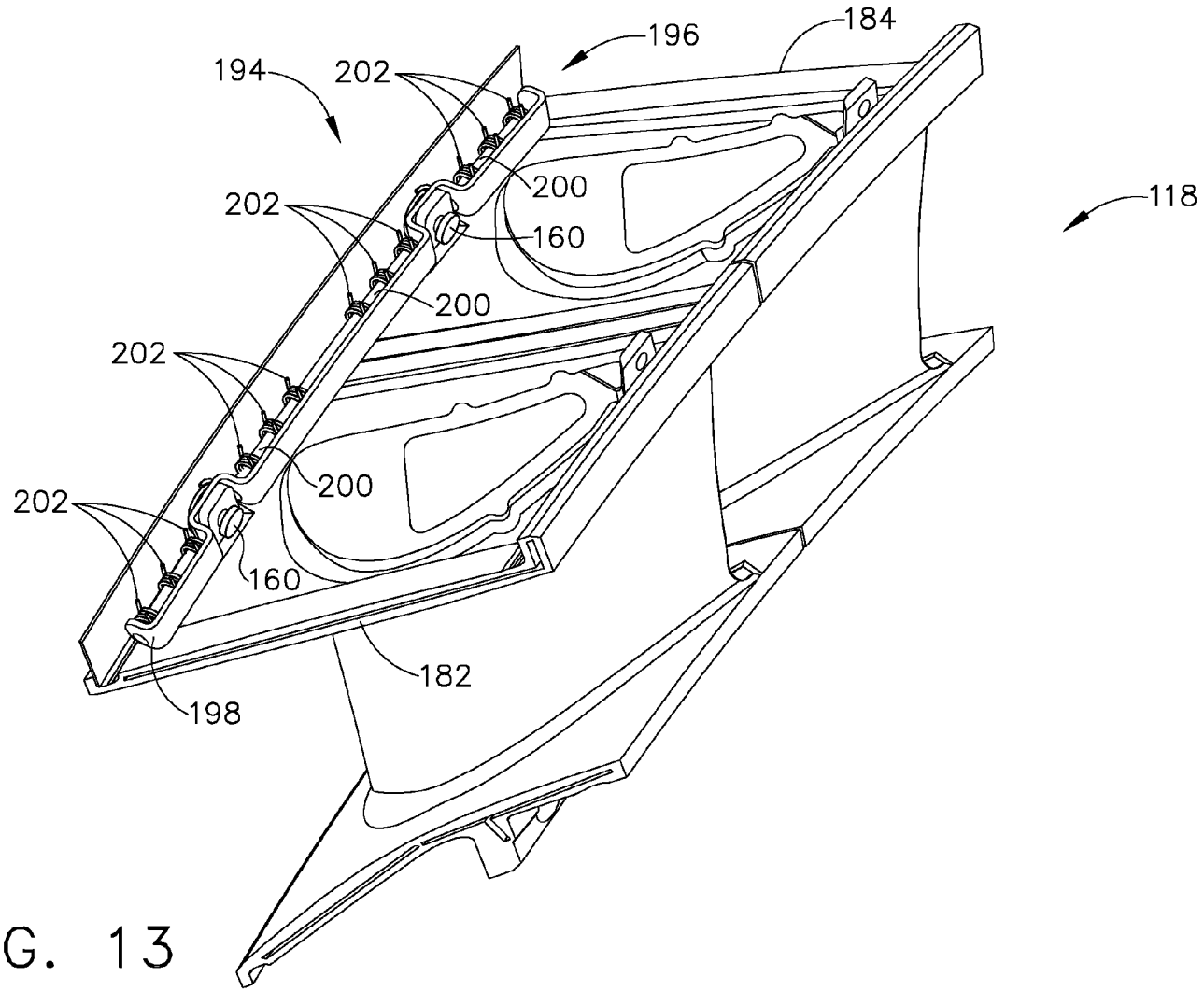
FIG. 13 is a perspective view of yet another exemplary turbine nozzle segment.
Figure 14:
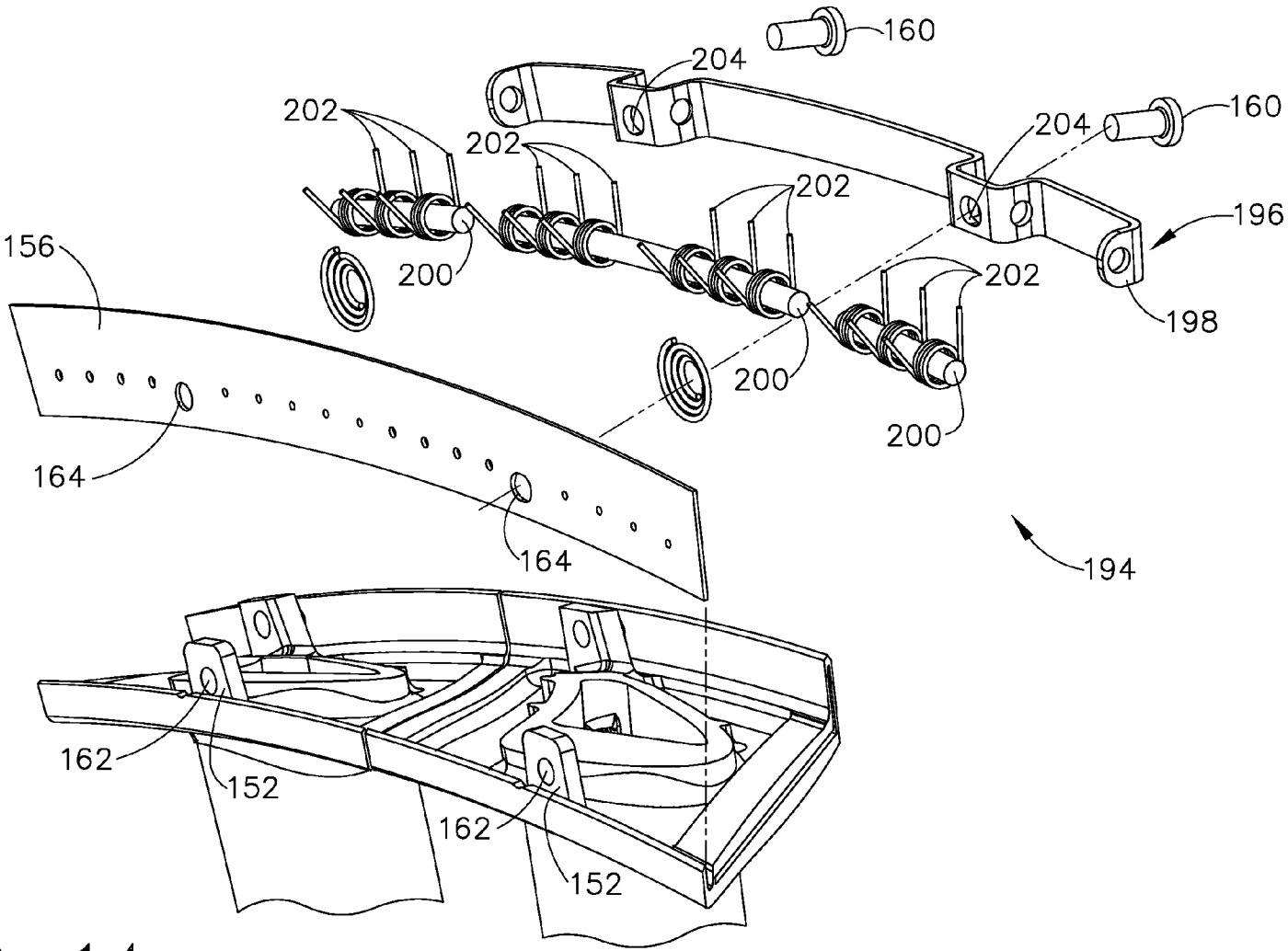
FIG. 14 is a perspective view of yet another exemplary support structure for use in an exemplary turbine nozzle segment.
Figure 15:
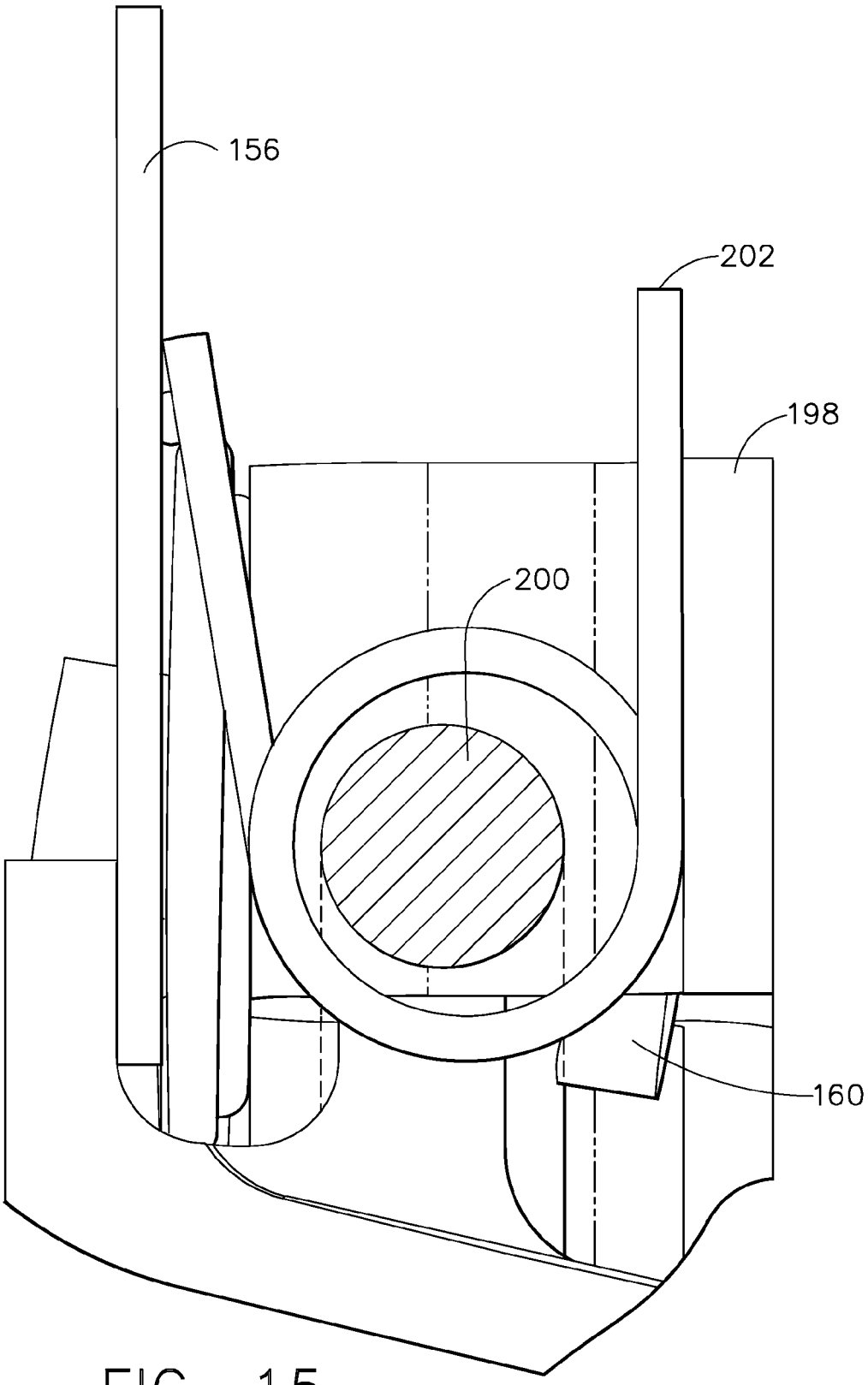
FIG. 15 is a close-up cross-sectional view of yet another exemplary turbine nozzle leaf seal assembly.
Figure 16:
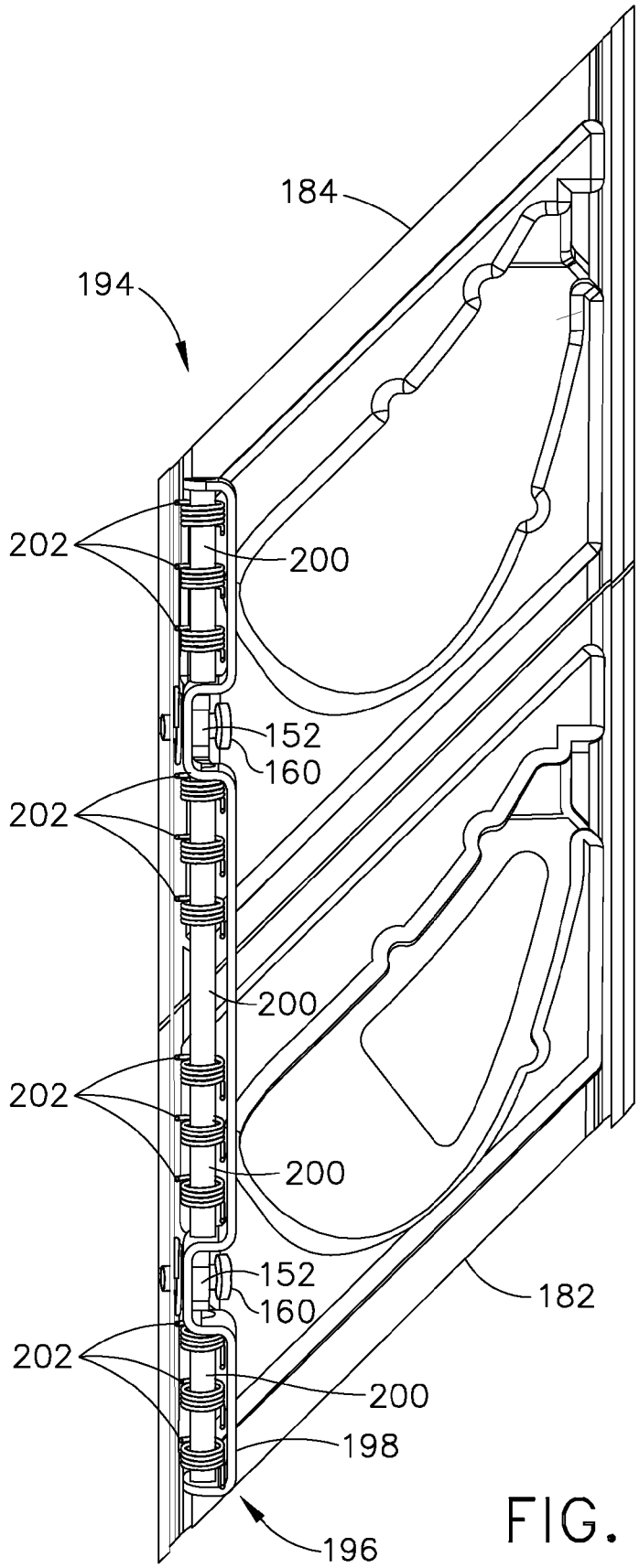
FIG. 16 is a top view of yet another exemplary turbine nozzle segment.

As shown in FIG. 2, the high-pressure turbine 108 may include a turbine nozzle assembly 116. The turbine nozzle assembly 116 may be downstream of the combustor 106 or a row of turbine blades. The turbine nozzle assembly 116 includes an annular array of turbine nozzle segments 118. A plurality of arcuate turbine nozzle segments 118 may be joined together to form an annular turbine nozzle assembly 116. As shown in FIGS. 2-16, the nozzle segments 118 may include one or more airfoils 120 extending between an inner band 122 and an outer band 124. The airfoils 120 may be hollow and have internal cooling passages or may receive one or more cooling inserts. The airfoils 120, inner band 122 and/or outer band 124 may be formed as an integrally cast piece or may be formed separately and joined together by brazing. For example, an airfoil 120 may be integrally cast with an outer band 124 and an inner band 122 may be brazed to the airfoil. The inner and outer bands 122 and 124 may have one or more axially spaced apart rails for connecting the nozzle segment 118 to upstream and downstream adjoining components.

The inner band 122 may include a forward rail 126 and an aft rail 128. The inner band 122 may also have a plurality of circumferentially spaced apart tabs 130. The tabs 130 may be axially spaced from the forward rail 126 defining a recess 132 between the tabs 130 and the forward rail 126. A leaf seal 134 may be disposed within the recess 132 and positioned to abut an adjoining component. In one exemplary embodiment, the adjoining component may be a combustor liner, such as combustor liner 136. In another exemplary embodiment, the adjoining component may be a turbine shroud.

The outer band 124 may include a forward rail 148 and an aft rail 150. The outer band 124 may also have a plurality of circumferentially spaced apart tabs 152. The tabs 152 may be axially spaced from the forward rail 148 defining a recess 154 between the tabs 152 and the forward rail 148. A leaf seal 156 may be disposed within the recess 154 and positioned to abut an adjoining component. In one exemplary embodiment, the adjoining component may be a combustor liner, such as combustor liner 158. In another exemplary embodiment, the adjoining component may be a turbine shroud.

In one exemplary embodiment, as shown in FIGS. 2-6, a leaf seal assembly 170 may be attached to the turbine nozzle segment 118. This exemplary embodiment is being described and shown in relation to the outer band 124. It should be apparent that the exemplary embodiment could also apply to the inner band 122 and should not be limited to the outer band 124. The leaf seal assembly 170 may include a support structure 166. The support structure 166 may have a bar 172, a plurality of slots 174, and a plurality of biasing structures 168. The bar 172 is attached to the outer band 124 by aligning the tabs 152 with the slots 174 in the bar 172 and then inserting the tabs 152 into the slots 174. To complete the attachment and hold the components in place, pins 160 may be placed through holes 176 in the bar 172, that align with holes 162 in the tabs 152. At least one of the holes 176 in the bar 172 may be larger in size than the other to allow for the thermal expansion that may occur with the components. For example, one of the holes 176 may be a racetrack hole. The biasing structures 168 may be attached to or integral with the bar 172. For example, the biasing structures 168 may be attached with pins 180. The pins 180 may be placed through holes 178 in the bar 172, and the holes 164 in the leaf seal 156. The biasing structures 168 could also be brazed to the bar 172 or formed with the bar 172 as a one-piece structure. There may be any number of biasing structures 168 which may be spaced apart circumferentially. Any type of biasing structure known in the art may be used, such as, but not limited to, a coil spring, a spring finger, a torsion spring, or any other biasing structure. In one exemplary embodiment, one may be adjacent to a circumferential edge 182 of the outer band 124, one adjacent to another circumferential edge 184 of the outer band 124, and one or more therebetween.

In another exemplary embodiment, as shown in FIGS. 7-11, a leaf seal assembly 186 may be attached to the turbine nozzle segment 118. This exemplary embodiment is being described and shown in relation to the outer band 124. It should be apparent that the exemplary embodiment could also apply to the inner band 122 and should not be limited to the outer band 124. The leaf seal assembly 186 may include a support structure 188. The support structure 188 may have a bar 190 and a plurality of biasing structures 192. The bar 190 is attached to the outer band 124 by placing pins 160 through holes 194 in the bar 190, that align with holes 162 in the tabs 152, and the holes 164 in the leaf seal 156. A biasing structure 191 may also be attached to the pins 160. The biasing structures 192 may be integral with the bar 190. For example, the bar 190 and biasing structures 192 may be formed by bending and cutting a piece of sheet metal or other similar material. There may be any number of biasing structures 192 which may be spaced apart circumferentially. In one exemplary embodiment, a plurality of biasing structures 192 may be adjacent to a circumferential edge 182 of the outer band 124, a plurality adjacent to another circumferential edge 184 of the outer band 124, and a plurality therebetween.

In yet another exemplary embodiment, as shown in FIGS. 12-16, a leaf seal assembly 194 may be attached to the turbine nozzle segment 118. This exemplary embodiment is being described and shown in relation to the outer band 124. It should be apparent that the exemplary embodiment could also apply to the inner band 122 and should not be limited to the outer band 124. The leaf seal assembly 194 may include a support structure 196. The support structure 196 may have a bar 198, one or more rods 200 and a plurality of biasing structures 202. The bar 198 is attached to the outer band 124 by placing pins 160 through holes 204 in the bar 190, that align with holes 162 in the tabs 152, and the holes 164 in the leaf seal 156. The biasing structures 202 may be placed onto the rod 200 that is attached to the bar 198. There may be any number of biasing structures 202 which may be spaced apart circumferentially. In one exemplary embodiment, a plurality of biasing structures 202 may be adjacent to a circumferential edge 182 of the outer band 124, a plurality adjacent to another circumferential edge 184 of the outer band 124, and a plurality therebetween.

During operation, the leaf seals are biased into abutting contact with adjoining components to provide sealing between the turbine nozzle segment and the adjoining components. The exemplary embodiments described provide additional support to the leaf seals in areas susceptible to damage, such as, but not limited to, areas adjacent to the circumferential edges of the inner and/or outer bands and the central areas therebetween. The exemplary embodiments may also increase the mechanical sealing load and reduce the unsupported length of the leaf seals.

This written description discloses exemplary embodiments, including the best mode, to enable any person skilled in the art to make and use the exemplary embodiments. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine nozzle segment, comprising:
- a first band having a plurality of tabs;
- an airfoil extending from said first band;
- a rail extending from said first band and spaced from said plurality of tabs defining a recess therebetween;
- a leaf seal assembly attached to the plurality of tabs, the leaf seal assembly comprising
  - a leaf seal disposed in said recess,
  - a support structure attached to said plurality of tabs and to said leaf seal, said support structure comprising
    - a bar comprising a plurality of slots configured to receive respective ones of said plurality of tabs therein, and
    - a plurality of biasing structures mounted to said bar and disposed between said bar and said leaf seal.

2. The turbine nozzle segment of claim 1 wherein at least one of said plurality of biasing structures is adjacent a circumferential edge of said first band.

3. The turbine nozzle segment of claim 1 further comprising:
- a second band;
- wherein said airfoil extends between said first band and said second band.

4. The turbine nozzle segment of claim 1 further comprising:
- a pin extending through each of said tabs and said support structure for attaching said support structure to said first band.

5. The turbine nozzle segment of claim 1 wherein said biasing structures are selected from the group consisting of coil springs, finger springs, and torsion springs.

6. The turbine nozzle segment of claim 1 wherein said biasing structures are integral with said support structure.

7. The turbine nozzle segment of claim 1 further comprising:
- a rod associated with said support structure.

8. The turbine nozzle segment of claim 7 wherein said biasing structures are positioned onto said rod.

9. The turbine nozzle segment of claim 1, wherein at least one of said plurality of biasing structures is mounted to said bar between said tabs.

10. A turbine nozzle segment, comprising:
- a first band having a plurality of tabs;
- a second band;
- an airfoil extending between said first band and said second band;
- a support structure attached to said plurality of tabs, said support structure having a plurality of biasing structures spaced circumferentially apart;
- a rod associated with said support structure;
- a rail extending from said first band and spaced from said plurality of tabs defining a recess therebetween;
- a leaf seal disposed in said recess; and
- a in extending through each of said tabs and said support structure for attaching said support structure to said first band;
- wherein one of said biasing structures is adjacent a first circumferential edge of said first band and another of said biasing structures is adjacent a second circumferential edge of said first band; and
- wherein said biasing structures are selected from the group consisting of coil springs, finger springs, and torsion springs.

11. The turbine nozzle segment of claim 10 wherein said biasing structures are positioned onto said rod.

12. The turbine nozzle segment of claim 10,
- wherein said support structure comprises a bar; and
- wherein said rod is disposed substantially parallel to said bar.

13. The turbine nozzle segment of claim 10, wherein each pin extends through a hole in a respective one of said tabs, a respective hole in said support structure, and a respective hole in said leaf seal.

14. The turbine nozzle segment of claim 10, wherein at least one of said biasing structures comprises a torsion spring positioned on said rod and arranged to bias apart said support structure and said leaf seal.

15. The turbine nozzle segment of claim 10, wherein said rod is disposed generally perpendicular to said pins.

16. A leaf seal assembly for a turbine nozzle assembly, the leaf seal assembly comprising:

a leaf seal configured to be disposed in a recess at least partially defined by a circumferential rail extending from a first band associated with a turbine nozzle segment and a plurality of tabs associated with the first band; and a support structure with the leaf seal mounted thereto, the support structure comprising a bar comprising a plurality of slots configured to receive respective ones of the plurality of tabs therein, and a plurality of biasing structures mounted to the bar and disposed between the bar and the leaf seal;

wherein at least one of the plurality of biasing structures is mounted to the bar between at least two of the plurality of slots; and wherein at least one of the plurality of biasing structures is mounted to the bar between at least one of the plurality of slots and a circumferential edge of the first band.

17. The leaf seal assembly of claim 16, further comprising a pin configured to extend through an individual one of the tabs and the bar for attaching the bar to the first band.

18. The leaf seal assembly of claim 16, further comprising a pin extending through the bar, one of the plurality of biasing structures, and the leaf seal.

19. The leaf seal assembly of claim 18, wherein the pin does not extend through any of the tabs.

20. The leaf seal assembly of claim 16, wherein the biasing structures are selected from the group consisting of coil springs, finger springs, and torsion springs.

* * * * *